US007257471B2

(12) United States Patent
Kornick et al.

(10) Patent No.: US 7,257,471 B2
(45) **Date of Patent: *Aug. 14, 2007**

(54) COMMUNICATIONS DEVICE FOR REMOTE CONTROL OF RAIL TRACK SWITCHES IN A TRAIN YARD

(75) Inventors: David Kornick, Melbourne, FL (US); Robert James Foy, Melbourne, FL (US); Eric B. Moore, Jacksonville, FL (US); John Welsh McElroy, Merritt Island, FL (US); Chris Luevano, Merritt Island, FL (US); George Freeman, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 63 days.

This patent is subject to a terminal disclaimer.

(21) Appl. No.: 11/036,708

(22) Filed: Jan. 14, 2005

(65) Prior Publication Data

US 2005/0228552 A1 Oct. 13, 2005

Related U.S. Application Data

(63) Continuation-in-part of application No. 10/759,319, filed on Jan. 16, 2004.

(60) Provisional application No. 60/528,862, filed on Dec. 11, 2003, provisional application No. 60/448,701, filed on Feb. 20, 2003.

(51) Int. Cl.
*B60T 3/00* (2006.01)
*B06G 1/00* (2006.01)

(52) U.S. Cl. ..... 701/19; 246/182 C

(58) Field of Classification Search ..... 701/1, 701/24, 19, 117; 246/167 R, 191, 187 A, 246/182 AB, 27, 38, 143, 182 C; 700/33
See application file for complete search history.

(56) References Cited

U.S. PATENT DOCUMENTS 2,951,452 A 9/1960 Karlet (Continued)

FOREIGN PATENT DOCUMENTS

DE 19743306 A1 4/1999

(Continued)

OTHER PUBLICATIONS

Joe Denny, et al., *Communications-Based Yard Control (CB:YC <TM >) System*, Proceedings of the 2000 ASME/IEEE Joint Railroad Conference, Newark, NJ, Apr. 4-6, 2000, Proceedings of the ASME/IEEE Joint Railroad Conference, New York, NY: IEEE, US, Apr. 4, 2000, pp. 95-110, XPO10512397.

*Primary Examiner*—Dalena Tran
(74) *Attorney, Agent, or Firm*—Carlos Hanze, Esq; Enrique J. Mora, Esq; Beusse, Wolter, Sanks, Mora & Maire, P.A.

(57) ABSTRACT

A communications device is provided for routing a locomotive over a track layout in a train yard. The locomotive is operable over a plurality of alternative track routes to reach a respective destination from a plurality of possible destinations in said track layout. The track layout includes a plurality of switches configured to alter a route for a locomotive running along the track layout. The communications device may include a first user display for use in commanding a desired destination for the locomotive within the track layout by setting the state of the switches along the route to the destination.

7 Claims, 3 Drawing Sheets

U.S. PATENT DOCUMENTS

| | | | |
|---|---|---|---|
| 5,437,422 | A | 8/1995 | Newman |
| 5,685,507 | A | 11/1997 | Horst et al. |
| 5,751,569 | A | 5/1998 | Metel et al. |
| 5,758,848 | A | 6/1998 | Beule |
| 5,775,647 | A | 7/1998 | Wyatt |
| 6,135,396 | A | 10/2000 | Whitfield et al. |
| 6,246,956 | B1 | 6/2001 | Miyoshi et al. |
| 6,314,345 | B1 | 11/2001 | Coombes |
| 6,330,499 | B1 | 12/2001 | Chou et al. |
| 6,445,150 | B1 | 9/2002 | Tanner et al. |
| 6,480,810 | B1 | 11/2002 | Cardella et al. |
| 6,658,331 | B2 * | 12/2003 | Horst et al. ..... 701/19 |
| 6,848,657 | B2 * | 2/2005 | Young et al. ..... 246/1 R |
| 6,975,927 | B2 * | 12/2005 | Szklar et al. ..... 701/19 |
| 6,996,461 | B2 * | 2/2006 | Kane et al. ..... 701/19 |

FOREIGN PATENT DOCUMENTS

| | | |
|---|---|---|
| DE | 19840715 C1 | 11/2000 |
| DE | 10117387 A1 | 10/2002 |
| WO | WO 95/10439 | 4/1995 |

* cited by examiner

COMMUNICATIONS DEVICE FOR REMOTE CONTROL OF RAIL TRACK SWITCHES IN A TRAIN YARD

This application is a Continuation-In-Part, and claims filing date benefit, of U.S. application Ser. No. 10/759,319 filed Jan. 16, 2004, which in turn claims priority to a provisional application filed on Feb. 20, 2003, having application No. 60/448,701, and to a provisional application filed on Dec. 11, 2003, having application No. 60/528,862, each of which is incorporated herein by reference in their entirety.

FIELD OF THE INVENTION

The present invention is generally related to railroad communication devices, and, more particularly, to a communications device for remote control of rail track switches at a train yard.

BACKGROUND OF THE INVENTION

Known train routing techniques at a train yard require access to and the use of separate communication devices, and further require time consuming and burdensome coordination among various personnel to ensure that an appropriate selection and activation of rail track switches is accurately performed to achieve a desired transfer or routing of a locomotive from a given location to a desired destination within the train yard.

In one known technique, the operator at the train yard may request actuation of each individual rail track switch along a route of movement of the locomotive via a handheld voice radio using a set of DTMF tones unique to each switch. For example, the same operator also controls movement of a remote controlled locomotive (RCL) with a separate device, e.g., an operator control unit (OCU) for such a locomotive. The fact that the operator simultaneously needs to physically handle two separate devices may result in sub-optimal operations from an ergonomics point of view. In addition, requesting activation of an individual switch at a time may be rather cumbersome considering that in a typical train yard to reach a desired destination may involve activating a switching combination comprising a plurality of switches. In large railyards, there are numerous tracks, switches, possible routes and switch combinations. In the known techniques, the operator must identify the appropriate switches for the desired route, interact via a cell phone with each of these switches on an individual basis, confirm that each switch has moved to the desired state or switching position, and move the train via the OCU in increments between adjacent switches. Moreover, because of other traffic in the railyard, certain switches along a chosen route may not be available for use. Partial, and thus incomplete, movement of one locomotive may in turn interfere with the orderly movement of other locomotives in the yard. Also user displays in known portable train routing devices for train yard operations are usually limited to alphanumeric characters, and thus may not fully achieve the simplicity of operation and user friendliness that would be desirable.

In view of the foregoing considerations, it would be desirable to provide a communications device allowing an operator with the ability to control movement of the locomotive to accurately, reliably and cost-effectively input a switching combination that may comprise a plurality of switches for reaching the desired destination. It would also be desirable to provide a graphical user interface in such a communications device. Further it would be desirable to confirm that the switches necessary for a selected route are available for use and to confirm that these switches have been set in the necessary positions for the route before moving the locomotive.

BRIEF DESCRIPTION OF THE DRAWINGS

The advantages of the invention will be more apparent from the following detailed description in view of the following drawings.

DETAILED DESCRIPTION OF THE INVENTION

Figure 1:
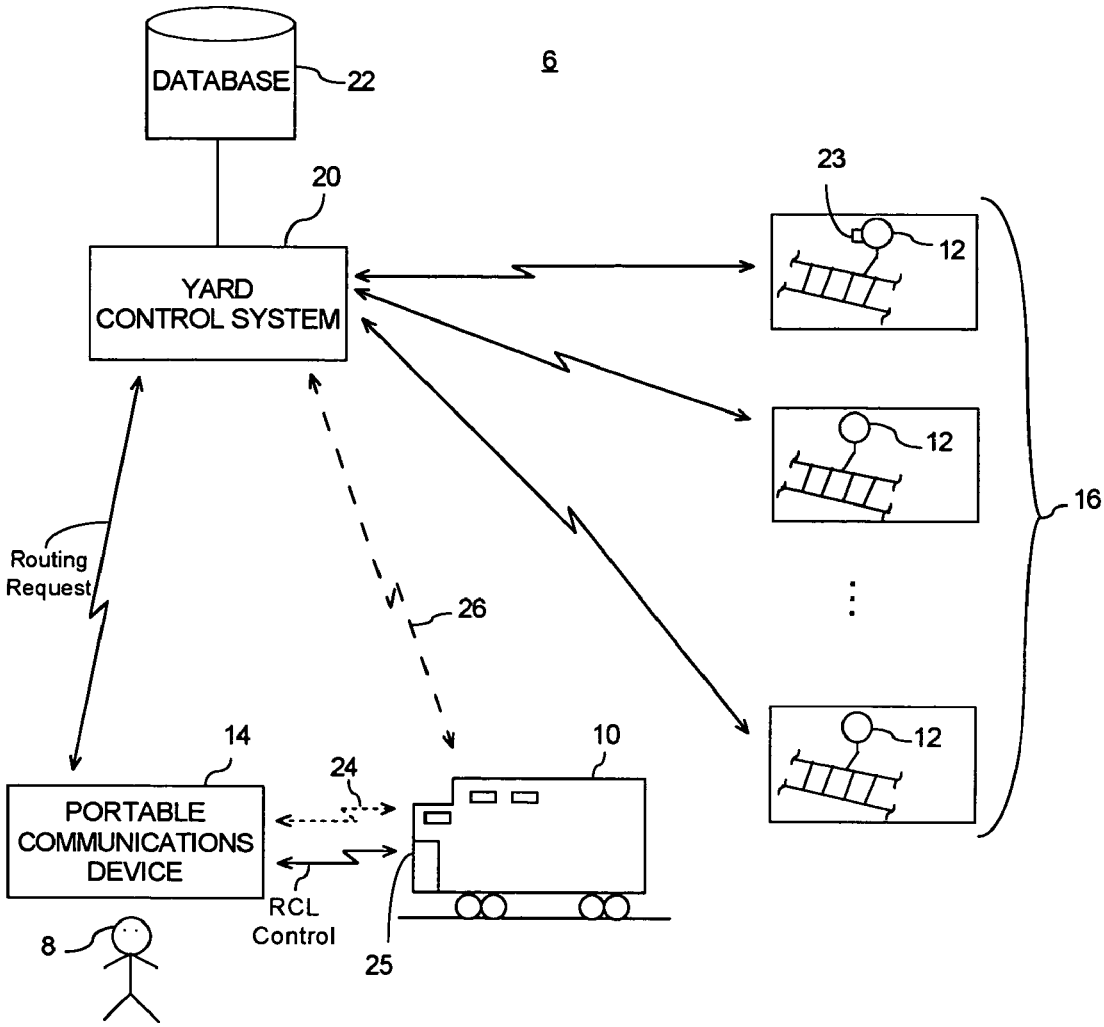
FIG. 1 is a schematic representation of an exemplary command communication and control (CCC) train rail yard system embodying aspects of the present invention.

As illustrated in the schematic representation of FIG. 1, a command communication and control (CCC) train rail yard system 6 embodying aspects of the present invention provides to an operator 8 of a Remote Controlled Locomotive (RCL) 10 the ability to actuate combinations of one or more remote controlled track switches 12 via a portable communications device 14, such as an Operator Control Unit (OCU) that may be hand-held or otherwise supportable by the body of the operator. Portable communications device 14 also allows the operator to control movement of the locomotive 10. This provides operator 8 with the ability to command a switching strategy for routing the locomotive and also guiding the locomotive from any given track to any other track in a rail track layout 16 of the train yard.

As will be appreciated by those skilled in the art, a train yard may comprise a large number of inter-connectable rail tracks, which are connectable through the actuation of appropriate combinations of switches (e.g., switches 12) to a suitable switching state. In a typical train yard operation, routing a locomotive from one track to another track may require setting to the appropriate switching state a plurality of switches.

Figure 2:
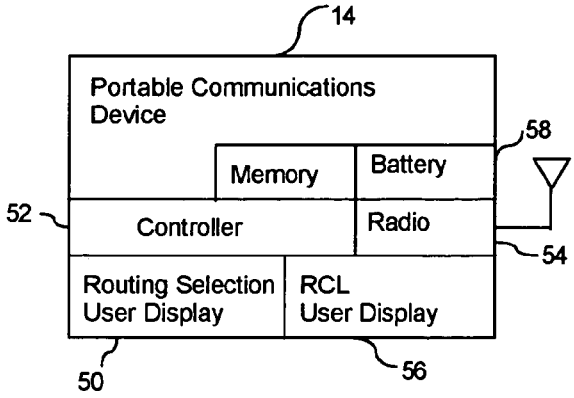
FIG. 2 is a block diagram of an exemplary embodiment of a portable communications device, as may be part of the train rail yard system of FIG. 1, configured to integrate a first user display for selecting a desired route within a train yard, and a second user display for controlling movement of the locomotive.

In one exemplary embodiment portable communications device 14 (FIG. 2) comprises a first user display or user interface 50 for selecting a desired route. This may allow communicating a routing request message, such as requesting a transfer from a given entrance gate to a desired exit gate. In one exemplary embodiment, the communications device 14 comprises a controller 52, such as a dedicated micro-controller, a Field Programmable Gate Array (FPGA) device, or Application Specific Integrated Circuit (ASIC) device, coupled to a radio device 54 and responsive to first user interface 50 to communicate command routing information to a yard control system 20 (FIG. 1) by way of a radio message that carries data indicative of the desired routing or transfer for the locomotive. By way of example and not of limitation one yard control system that may be suitable for implementing aspects of the present invention may be the system referred in commerce as Proyard NX yard control system.

Portable communications device 14 further comprises a second user display or user interface 56 for controlling movement of the locomotive, such as propulsion power, braking action, speed control, and other functionality useful in a moving locomotive, such as horn actuation, light control, etc. A battery 58 or other suitable power source may be used for electrically powering the various electronic modules that make up the portable communications device 14.

A database 22 (FIG. 1), as may be coupled to the yard control system 20, comprises data files and program code that allows generating switching commands for activating to an appropriate switching position a switch (or combination of switches) required for reaching the desired routing specified by operator 8 via the portable communications device 14. For example, the message for routing the locomotive from the given entrance gate to the desired exit gate may require activation of a given combination of switches to a respective switching state. Instead of yard personnel determining which particular combination of switches shall be activated, the database would be programmed to automatically make the appropriate switching selection in response to the message requesting the desired routing.

In the event, any of the tracks needed for implementing the transfer is not available, one or more alternative switching routes would be implemented for reaching the desired track. For example, routing the locomotive from the given entrance gate to the desired exit gate may normally require passing through a particular track. However, in the event another locomotive is already using that particular track, the database would select an alternative switching combination that avoids going through that particular track. Once each of the switches in the switching combination is set to the appropriate switching position, a confirmation or verification message may be sent to the operator to acknowledge execution of the switching strategy for routing the locomotive from the given entrance gate to the desired exit gate, for example.

Aspects of the present invention are expected to lead to greater reliability and productivity regarding train yard operations since, for example, a single operator would be able to remotely control movement of the locomotive and command a routing strategy from a single communications device and no additional personnel would be needed as intermediaries for figuring out which switching combination needs to be performed to reach a desired track. This would further allow the operator of the RCL to focus his attention on safely controlling the locomotive as opposed to having to deal with the burdensome logistics of manually trying to figure out the specific switching combination that needs to be performed or having to coordinate with other personnel to make the specific switching combination.

In one exemplary embodiment, once the appropriate switch combination is set, a suitable transducer 23 (FIG. 1 illustrates one such transducer) in each switch may be responsive to a corresponding switch state and may be configured to transmit a status message back to the yard control system and in turn to operator 8 via the portable communications device 14. Thus, the operator will be informed essentially in real time whether the original transmitted command for performing a given switch combination was executed.

In another exemplary embodiment, once the operator selects a desired routing, the routing command as represented by dashed line 24 may be optionally sent from the portable communications device 14 to the locomotive 10 in lieu of being sent to the yard control system. In this case, onboard communication equipment 25 will receive the routing command and in turn transmit that routing command via a suitable onboard radio coupled to the yard control system, as represented by dashed line 26. Similarly, a message with verification of execution of the routing command may be sent back to the operator via the radio onboard the locomotive.

Figure 3:
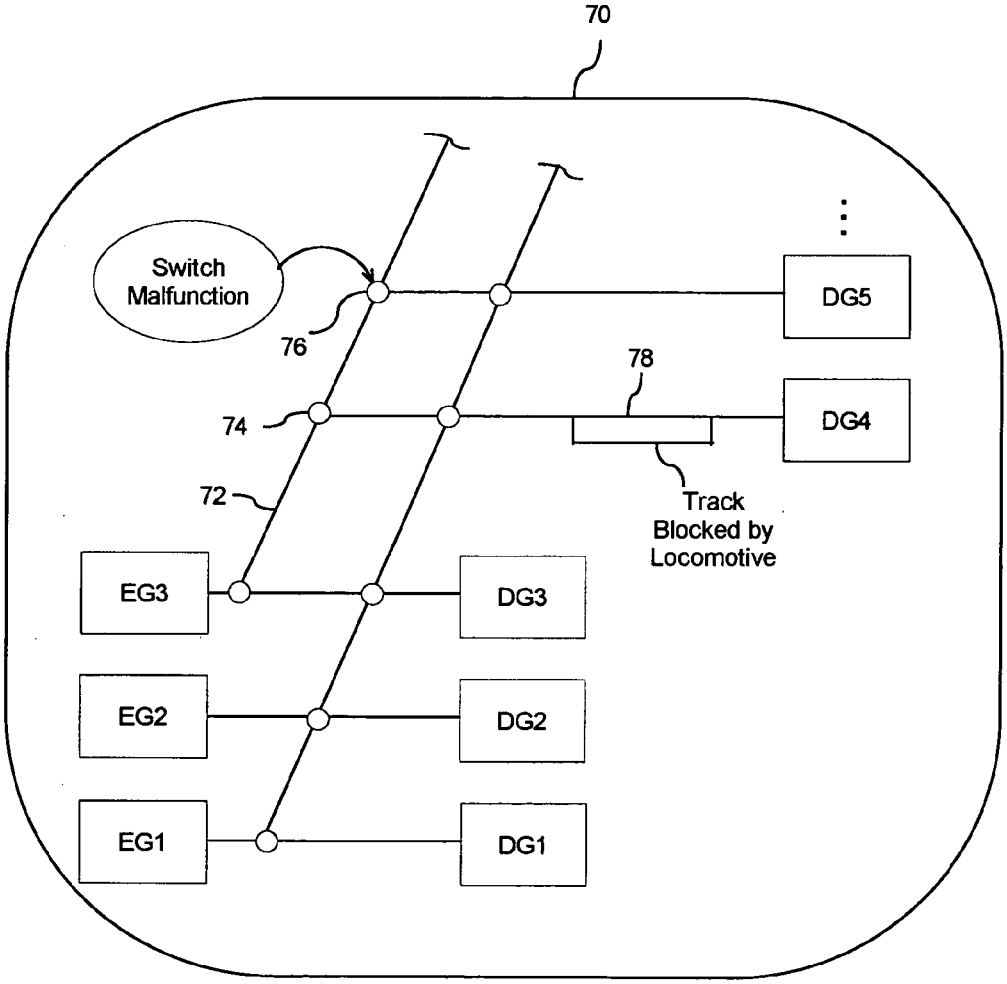
FIG. 3 is an exemplary representation of graphical user interface as may be used for displaying information to an operator in connection with a route status within the train yard.

FIG. 3 is an exemplary representation of graphical user interface (GUI) 70 as may be used for displaying information to an operator in connection with a route status within the train yard. For example, the graphical user interface may graphically display a map of a plurality of entrance gates, (designated EG1-EG3), and a plurality of destination gates (designated DG1-DG5) and including possible rail tracks 72 and 78 and switching nodes 74 and 76 for interconnecting such gates. Various types of information may be displayed on the GUI, such as whether there is a malfunction at a switching node 76, or whether a track 78 is presently blocked by another locomotive.

For smaller railyards having fewer tracks, switches and potential routes for the locomotives, the database 22 may be stored on the OCU or a locomotive control unit for example on a so-called switcher locomotive, with the communications with the switches being accomplished via the OCU or the locomotive control unit.

Figure 4:
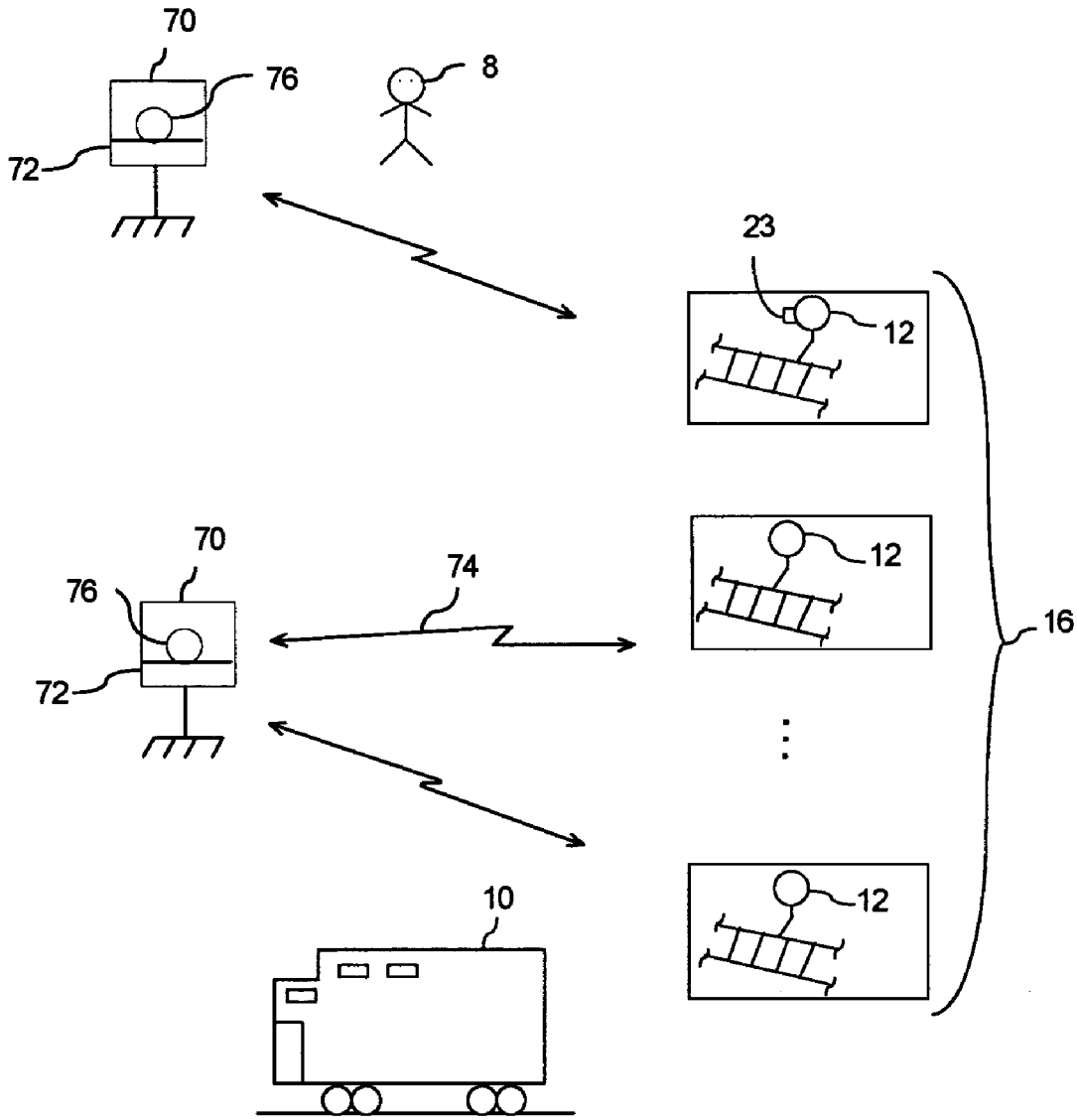
FIG. 4 illustrates an exemplary embodiment wherein the communications device takes the form of one or more user interface devices positioned wayside in the yard, such as one or more user stationary interface panels strategically positioned throughout one or more zones in the train yard to be accessible to one or more operators working in the yard.

FIG. 4 illustrates an exemplary embodiment wherein the communications device takes the form of one or more user interface devices positioned wayside in the yard, such as one or more user stationary interface panels 70 strategically positioned throughout one or more zones in the train yard to be accessible to one or more operators 8 working in the yard. Each user interface comprises data files and program code that allows generating the switching commands and the wireless transmission of such commands for activating to an appropriate switching position a remote switch 12 (or combination of switches) required for reaching the desired routing specified by a given operator 8 via any of the user interface panels 70. It will be appreciated that the communications link in this embodiment may form a direct wireless communications link between the user interface and the remote controlled track switches 12, thereby eliminating the need to communicate such commands either via the yard control system 20 (FIG. 1) or via communications equipment onboard the locomotive 10. In this case, a transceiver 72 or any suitable communications device in the user interface panel 70 can directly transmit the routing commands to the remote controlled track switches 12, as represented by line 74. Similarly, a message with verification of execution of the routing command may be directly sent back to the user interface panel 70 to inform the operator of the status of any of the remote controlled track switches 12. For example, a green indication for a given switch may indicate normal operation for that switch. A yellow indication for a given switch may indicate inability to verify the switching position of that switch. A red indication for a given switch may indicate inability of that switch to follow a command. In one exemplary embodiment, each user interface panel 70 may communicate the switching commands to a control room via a wireless link in lieu of communicating directly with the remote controlled track switches 12.

In this exemplary embodiment, user interface device 70 comprises a graphical user interface 76 and keyboard for selecting and/or verifying the selection of a desired route. However, it will be appreciated that aspects of the present invention may be implemented in different forms, such as via a portable communications device, or via one or more stationary user interface panels. Further, the communications link from the user interface to the remote controlled track switches 12 may be a direct link or may be an indirect link. In addition, the user interface 70 may be a stand-alone user interface. That is, the user interface for selecting and communicating the switching commands to the switches could, but need not be, integrated with a user interface that further allows the operator to remotely control movement of an unmanned locomotive on the tracks past the switches. When two or more interface devices are provided in a yard for controlling the switches in the yard, the devices communicate with each other, either directly or indirectly, to prevent the devices from giving contradictory commands to the switches.

In one exemplary embodiment, the user interface panel may be operated in a so-called "switch-stacking" mode. This allows an automated mode of operation for the user interface panel. For example, in this mode, the user interface panel automatically performs one or more operator-programmed sequences of switch movements (e.g., from one switching position to a second switching position) in order to select one or more desired routes for routing one or more locomotives in the train yard.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A communications device positioned wayside in the yard for routing a locomotive to a desired destination in a rail yard through a track layout comprising a plurality of rail tracks connectable to one another in response to a respective switching combination applied to a plurality of remotely controlled switches for interconnecting one track to another track, said communications device comprising:

a memory configured to store information indicative of the tracks in the yard and the switches interconnecting said tracks;

a user interface for displaying information indicative of the tracks in the yard and receiving a user input regarding a set of desired tracks to be interconnected to set a route for enabling the locomotive to reach the desired destination in the rail yard;

a processor responsive to the user input to identify the switches to be actuated to interconnect the set of desired tracks and the positions for the switches to make the interconnection of said tracks;

a transmitter configured to wirelessly transmit a switching combination to be applied to respective ones of the plurality of remotely controlled switches to implement said at least one route; and a receiver responsive to information received from said respective ones of the plurality of remotely controlled switches regarding a status of the switches for interconnecting the tracks to set the route for reaching the desired destination.

2. The communications device of claim 1 wherein said user interface comprises at least one stationary user interface panel disposed at said rail yard.

3. The communications device of claim 1 wherein said user interface comprises a hand-held user interface.

4. A communications device for routing a locomotive over a track layout in a train yard, said locomotive operable over a plurality of alternative track routes to reach a respective destination from a plurality of possible destinations in said track layout, said track layout including a plurality of switches configured to alter a route for a locomotive running along said track layout, said communications device comprising:

a graphical user interface for commanding a desired destination for said locomotive within said track layout, said graphical user interface configured to display a representation of said track layout, and wherein said representation allows an operator with remote control means for controlling movement of said locomotive to monitor operational conditions of the switches that may develop along the route of the locomotive.

5. A communications device for routing a locomotive over a track layout in a train yard, said locomotive operable over a plurality of alternative track routes to reach a respective destination from a plurality of possible destinations in said track layout, said track layout including a plurality of switches configured to alter a route for a locomotive running along said track layout, said communications device comprising:

a user display positioned wayside in the train yard to enable an operator at the train yard with remote control means for controlling movement of said locomotive to command a desired destination for the locomotive within said track layout by setting the state of the switches along the route to the destination through a wireless communications link, wherein the user display is accessible by the operator at the train yard, thereby enabling said operator to individually (1) control movement of said locomotive, and (2) directly set the state of the switches along the route to the destination through the wireless communications link independent from a train yard control system.

6. The communications device of claim 5 wherein said communications link comprises a direct communications link between said user display and the plurality of switches.

7. The communications device of claim 5 wherein said communications link comprises a communications link through intermediate communications equipment disposed between said user display and the plurality of switches.

* * * * *